US006276013B1

(12) United States Patent
Hansen et al.

(10) Patent No.: US 6,276,013 B1
(45) Date of Patent: Aug. 21, 2001

(54) BEVERAGE CAN TOP CLEANER AND TAB LIFTING DEVICE

(76) Inventors: Randall Mace Hansen, 2361 Box, Laughlin, NV (US) 89029; Tammy Sue Riggins, 8667 Elm St., Mohave Valley, AZ (US) 86440

( * ) Notice: Subject to any disclaimer, the term of this patent is extended or adjusted under 35 U.S.C. 154(b) by 0 days.

(21) Appl. No.: 09/220,756

(22) Filed: Dec. 28, 1998

(51) Int. Cl.[7] ..... B25F 1/00

(52) U.S. Cl. ..... 7/151; 7/105; 15/105; 15/245; 81/3.55

(58) Field of Search ..... 7/105, 151, 170; 81/3.55; 15/105, 117, 245

(56) References Cited

U.S. PATENT DOCUMENTS

| | | | |
|---|---|---|---|
| 4,967,622 | 11/1990 | Phillips . | |
| 5,169,305 | 12/1992 | Kee . | |
| 5,257,566 | 11/1993 | Schultz . | |
| 5,457,834 | 10/1995 | Allen, Sr. . | |
| 5,485,642 | 1/1996 | Wiggleton et al. . | |
| 5,507,052 | 4/1996 | Smith et al. . | |
| 5,621,936 | 4/1997 | Penaligon et al. . | |
| 5,996,169 * | 12/1999 | Cooper | 15/105 X |

FOREIGN PATENT DOCUMENTS

| | | |
|---|---|---|
| WO 97/06094 | 2/1997 | (FR) . |
| WO 95/28328 | 10/1995 | (KR) . |

* cited by examiner

*Primary Examiner*—James G. Smith
(74) *Attorney, Agent, or Firm*—Richard C. Litman

(57) ABSTRACT

A multi-purpose beverage can top cleaner and tab lifter device comprises a circular sponge insert for cleaning the can top rim and an inclined semicircular wedge for raising a lift-tab to open the drinking port simultaneously in one circular motion.

8 Claims, 2 Drawing Sheets

BEVERAGE CAN TOP CLEANER AND TAB LIFTING DEVICE

BACKGROUND OF THE INVENTION

1. Field of the Invention

The present invention relates to a combination beverage can top cleaner and tab lifting device.

2. Description of the Related Art

The related art of interest describes various can openers and can cleaners, but none show the combination of the present invention and its unique structure. The related art will be discussed in the order of perceived relevance to the present invention.

U.S. Pat. No. 5,507,052 issued on Apr. 16, 1996, to Nickie Smith et al. describes a rim cleaning beverage container opener comprising a handle having a squeegee at one end and a can and bottle opener at an opposite end. Four projecting tines and a prying member resembling a hand provide the opening means. The device is distinguishable for its significantly different linear structure.

WO 97/06094 published on Feb. 20, 1997, for Michel Delavis describes a hand tool for opening metallic beverage cans with a ring tab. The tool can open and close the ring tab. A flanged housing has an engagement tip and a handle at an opposite end. The handle has a lifting hook within the housing. A counter blade within the housing and above the lifting hook is utilized to press down the ring tab by tilting the tool downward. The tool is distinguishable for its significantly different linear structure and the omission of a cleaning agent.

U.S. Pat. No. 5,457,834 issued on Oct. 17, 1995, to Richard D. Allen, Sr. describes a curved snap fastener opener having a wedged rectangular shape with a recess at one end to slip between a snap fastener base and cap. The opener device is distinguishable for its unique shape and the lack of a cleaning agent.

U.S. Pat. No. 4,967,622 issued on Nov. 6, 1990, to David S. Phillips describes a planar beverage container opener having a stay-on tab opener on one end, a crimped-on bottle cap opener on an opposite end, and a twist-off bottle opener in a central socket portion. The opener is distinguishable for its different structure and multiple uses but not including a cleaning agent.

U.S. Pat. No. 5,169,305 issued on Dec. 8, 1992, to Dook-Seok Kee describes a multi-purpose gas lighter having an end for lifting a can tab and accepting the hem ridge of a drink can as a fulcrum. The lighter has two indentations with one closest to the end having a catch to lift up a can tab. The lighter is distinguishable for the different linear structure of the tab lifter and the lack of a cleaning agent.

U.S. Pat. No. 5,257,566 issued on Nov. 2, 1993, to Edward F. Schultz describes a thumb fitting, ring-like, flip-top can opening device and a method of using the device. The device is a split, ring-like shaped finger band with a pry end which is usually worn on a thumb. The pry end is slipped under the flip-top ring and the thumb twisted to elevate the flip-top ring. The simple ring device is distinguishable for its ring structure and the lack of a cleaning agent.

U.S. Pat. No. 5,485,642 issued on Jan. 23, 1996, to Patsy A. Wiggleton et al. describes a purse file with a pop top opener on one end having a head with a notched blade which engages a pop top of a soft drink can to lift it up. The device is distinguishable for its singular blade structure and the lack of a cleaning agent.

U.S. Pat. No. 5,621,936 issued on Apr. 22, 1997, to Janet L. Penaligon et al. describes a multi-purpose hand tool which can open a snap-open lid of a beverage container among its uses for turning keys in a keyway, filing fingernails, and opening envelopes, aspirin bottles, and medicine containers. The hand tool is designed for persons with physically impaired hands. Two circular or square halves having a ridged cavity in one half with a tab for attaching a split ring. The snap-open lid is placed within another cavity between the halves to twist the lid snap off. The hand tool is distinguishable for its different structure and operation in removing the tab of a snap-open lid.

WO 95/28328 published on Oct. 26, 1995, for Young C. Jung describes a beverage can with a sanitary top cover. A beverage can top is sealed with a shrinkable film with a tab and a notched tearing line. The sanitary top cover is distinguishable for its limited use to protecting the top of the can from contamination.

None of the above inventions and patents, taken either singularly or in combination, is seen to describe the instant invention as claimed. Thus, a beverage can top cleaner solving the aforementioned problems of cleaning the beverage can top and raising the lift-tab to open the can simultaneously is desired.

SUMMARY OF THE INVENTION

The present invention is directed to a device for simultaneously opening a beverage can having a lift-tab and cleaning any dirt collected in the depression adjacent to the rim. A round cover has a diameter to overlap the can and contains a sponge in its peripheral channel with space for accommodating the rim of the can. The center of the cover is open and holds a substantially semicircular inclined wedge adapted to raise up the lift-tab to open the can's port. The sponge is wetted and the cover applied to the top of the can. The wedge edge is aligned next to the lift-tab and the cover rotated clockwise to clean the rim and to open the can.

Accordingly, it is a principal object of the invention to provide a beverage can opening and cleaning device.

It is another object of the invention to provide a beverage can device for opening and cleaning a lift-tab soda or beer can in one simple circular motion.

It is a further object of the invention to provide a beverage can device having a curved inclined wedge on its bottom for raising the lift-tab and opening the can.

Still another object of the invention is to provide a beverage can device having a sponge ring attached to the bottom of the device in a channel with space for the rim for cleaning the surface of the can proximate the rim before opening.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
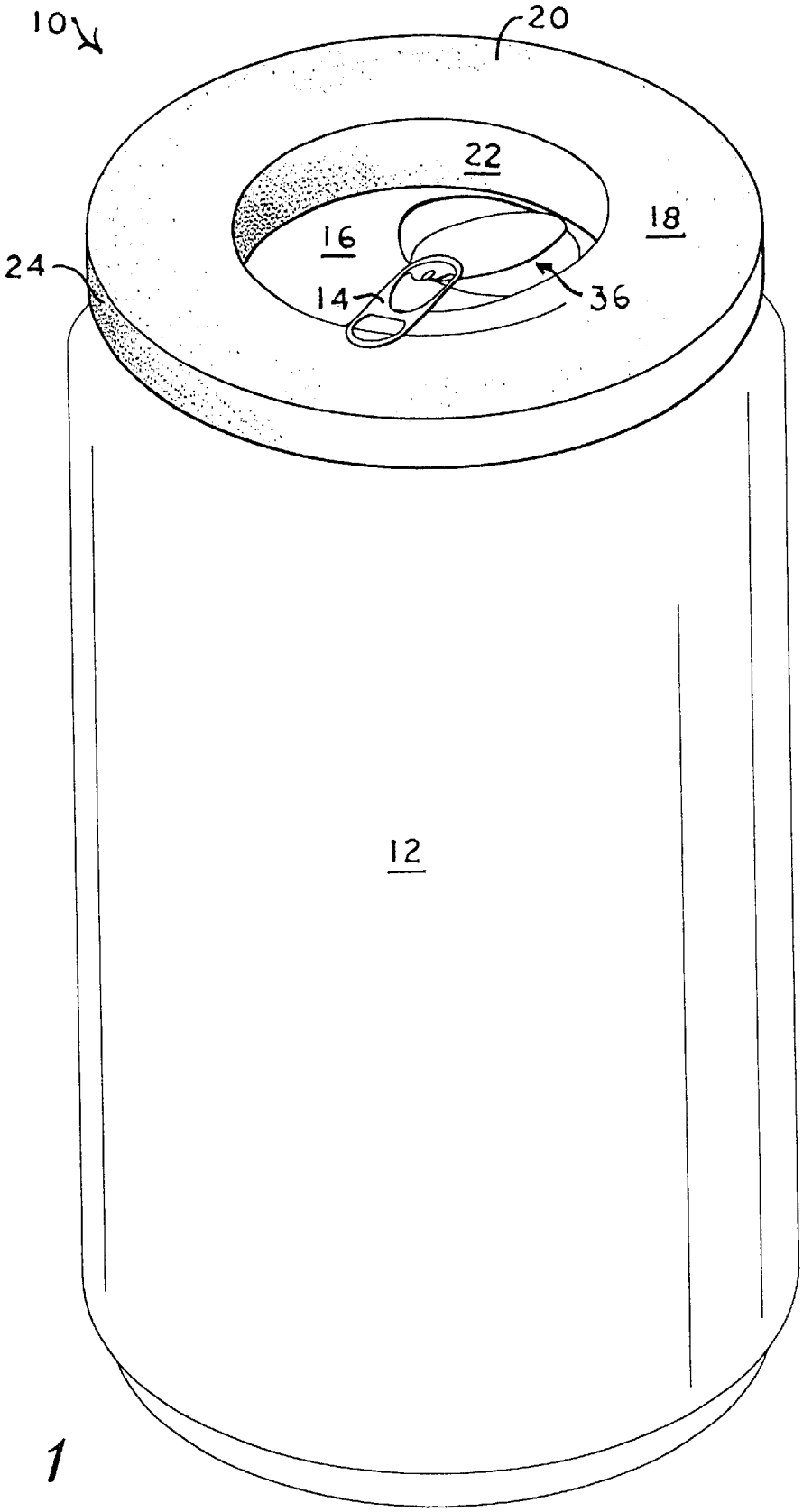
FIG. 1 is an environmental, perspective view of a beverage can top cleaner and tab lifting device positioned on a flip-top can according to the present invention.

The present invention is directed to a multi-purpose beverage can top cleaner and tab lifter device 10 shown in FIG. 1 positioned on a conventional beverage can 12 containing a soft drink or an alcoholic beverage having its lift-tab 14 raised effortlessly by an arcuate inclined wedge 16 attached on and contiguous to the inside of a circular cover 18 having a top annular surface 20, an inside annular side surface 22, and an outside annular side surface 24.

Figure 2:
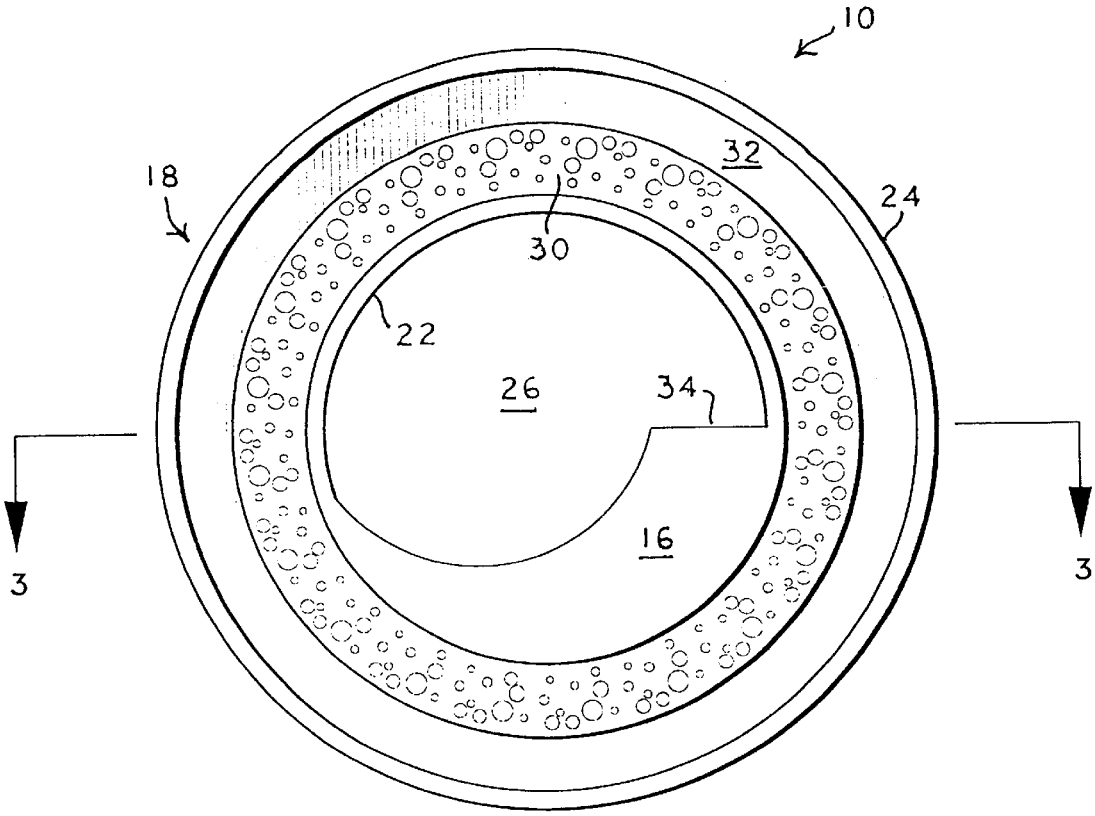
FIG. 2 is a bottom view of the present inventive device.
Figure 3:
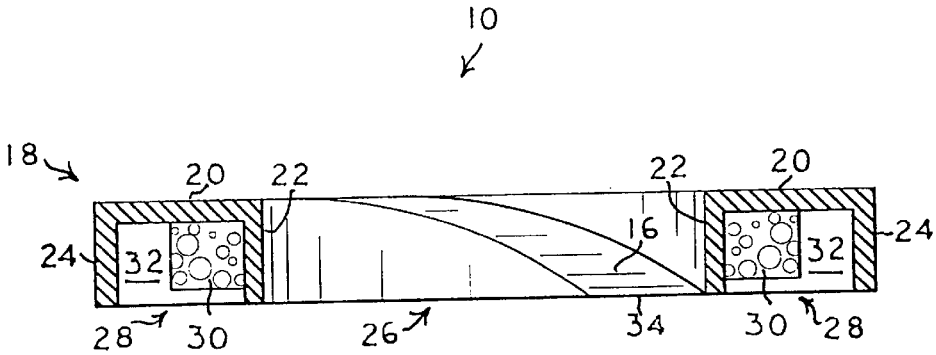
FIG. 3 is a sectional view drawn along lines 3—3 of FIG. 2.

Turning to FIGS. 2 and 3, the circular cover 18 has an open bottom 26, wherein the outside annular side surface 24 and the inside annular side surface 22 form an annular channel 28. The circular cover 18 is adapted to overlap the top rim of the beverage can 12 as depicted in FIG. 1. A sponge ring 30 is positioned in the channel 28 to leave a peripheral space 32 for inclusion of the top rim of the beverage can 12. The inclined arcuate wedge 16 is positioned within and contiguous to the inside annular side surface 22 and decreases in width from the wide edge 34 as the wedge 16 approaches the top annular surface 20. The wedge 16 extends less than a semicircle. The entire device 10 can be made of rigid plastic material.

The process of using this multi-purpose device 10 begins with the wetting of the sponge 30 with water. The device 10 is then placed on the beverage can 12 in a position to contact and press under the lift tab 14 with the wide edge 34 of the wedge 16. As the device 10 is rotated in a clockwise direction with a slight pressure for maintaining contact of the wet sponge 30 with top of the can 12 to clean its surface proximate to the rim, the lift tab 14 is readily lifted up to open up the can's port 36 shown in FIG. 1. Consequently, the rim of the beverage can 12 be cleaned of any debris and the lift-tab 14 can be raised to open the drinking port in one circular motion.

It should be understood that if the rim of the beverage can 12 is excessively dirty with dirt particles, the device 10 can be rotated in a counter-clockwise direction repeatedly if necessary to clean the rim area without lifting up the lift-tab 14.

Exemplary dimensions of the device 10 are as follows:

Diameter of the circular cover 18: 2⅜ in.

Diameter of the inside wall: 1 9/16 in. I.D.

Thicknesses of the walls: 1/16–⅛ in.

Sponge ring 30 thickness in width: 7/16 in.

Space 32 in channel 28 for the rim of a can 12: 10/16 in.

Height of the device 10: ½ in.

Width of wide edge 34 of wedge 16: 7/16 in.

Thus, an economical beverage can cleaner and tab lifter device has been shown which can be utilized in the home, the workplace and on outings.

It is to be understood that the present invention is not limited to the embodiment described above, but encompasses any and all embodiments within the scope of the following claims.

We claim:

1. A multi-purpose beverage can top cleaner and lift-tab lifter device comprising:

a circular cover having a top annular surface, an inside annular side surface, an outside annular side surface, and an open bottom to form an annular channel, and said circular cover adapted to overlap a top rim of a beverage can having a lift-tab for opening a port;

a sponge ring positioned in the channel; and an inclined wedge positioned within and contiguous to the inside annular side surface;

whereby the rim of the beverage can be cleaned of any debris and the lift-tab can be raised to open the drinking port in one circular motion.

2. The multi-purpose device according to claim 1, wherein a lower lip of the inclined wedge is configured and dimensioned to contact and to cause raising of the lift-tab from the beverage can.

3. The multi-purpose device according to claim 1, wherein the inclined wedge is substantially semicircular.

4. The multi-purpose device according to claim 1, wherein the inclined wedge has a bottom and an opposite end with decreasing surface area from the bottom to the opposite end, the bottom of the wedge being adapted to initially contact the lift-tab.

5. The multi-purpose device according to claim 4, wherein the inclined wedge slopes clockwise from the bottom as the device is rotated clockwise to clean and to lift up the lift-tab simultaneously.

6. The multi-purpose device according to claim 1, wherein the sponge ring is sized to occupy an inner portion of the channel, and is dampened to clean the top rim portion of the beverage can.

7. The multi-purpose device according to claim 1, wherein the sponge is a porous plastic material.

8. The multi-purpose device according to claim 1, wherein the cover and the inclined wedge are plastic.

* * * * *